US005839422A

United States Patent [19]

Ferris

[11] Patent Number: 5,839,422

[45] Date of Patent: Nov. 24, 1998

[54] AUTOMATIC FEEDER FOR PROJECTILE GUN USING COMPRESSED GAS

[76] Inventor: Shell M. Ferris, 1455 Holly Heights Dr., No. 38, Fort Lauderdale, Fla. 33304

[21] Appl. No.: 862,499

[22] Filed: May 23, 1997

[51] Int. Cl.[6] ..... F41B 11/02

[52] U.S. Cl. ..... 124/53.5

[58] Field of Search ..... 124/45, 49, 53.5, 124/82, 56, 72, 73, 74, 76; 221/200, 278; 414/304

[56] References Cited

U.S. PATENT DOCUMENTS

| | | | |
|---|---|---|---|
| 2,725,868 | 12/1955 | Foster | 124/53.5 X |
| 2,792,262 | 5/1957 | Hathorn | 414/304 X |
| 2,824,665 | 6/1958 | Lamouria | 221/278 X |
| 3,089,476 | 5/1963 | Wolverton | 124/53.5 X |
| 3,275,191 | 9/1966 | MacDonald | 221/278 X |
| 3,410,453 | 11/1968 | Lawrence | 221/200 X |
| 4,137,893 | 2/1979 | Beauchamp | 124/72 |
| 4,559,918 | 12/1985 | Ballerin et al. | 124/53.5 X |
| 5,251,906 | 10/1993 | Heller et al. | 124/72 X |
| 5,282,454 | 2/1994 | Bell et al. | 124/49 |
| 5,450,683 | 9/1995 | Miller | 221/278 X |
| 5,505,188 | 4/1996 | Williams | 124/49 X |
| 5,673,679 | 10/1997 | Walters | 124/53.5 |

*Primary Examiner*—John A. Ricci

*Attorney, Agent, or Firm*—Malin, Haley & DiMaggio & Crosby, PA

[57] ABSTRACT

A portable automatic projectile loading device for use with a gun-like apparatus typically utilizing compressed gas to fire projectiles. The device being capable of storing up to 1000 projectiles which are conveniently carried by the user in a coiled flexible hose contained, along with a compressed gas cylinder, in a pack preferably carried on the back. The projectiles may be paint, gelatin, or tear gas filled balls that rupture upon impact. The device utilizes compressed gas flowing through a flexible hose containing the projectiles to propel the projectiles into the breach of the gun-like apparatus.

6 Claims, 3 Drawing Sheets

AUTOMATIC FEEDER FOR PROJECTILE GUN USING COMPRESSED GAS

BACKGROUND OF THE INVENTION

1. Field of the Invention

This invention relates generally to gun-like apparatus that typically use pressurized gas to fire a projectile, and more particularly to a device to automatically feed projectiles, such as paint or tear gas balls, into a gun-like apparatus to be fired using pressurized gas. The device is portable and capable of storing a large number of projectiles.

2. Description of Related Art

Gun-like devices that use pressurized gas to fire projectiles are used, among other things, for recreational and training purposes, and in actual police-type operations. The projectiles can be any small object, such as, but not limited to, paint or tear gas balls that rupture upon impact. The guns are typically carried by a user and are connected to a cylinder of pressurized gas by a flexible hose. The cylinder is carried on the user's back. The gun can have a magazine that can hold up to 100 to 200 projectiles, and may be gravity-fed into the discharge position in the gun. If the gun is operating properly, one projectile will be discharged per trigger squeeze. Examples of guns of this type are disclosed in U.S. Pat. No. 5,515,838 to Anderson, at col. 1, lines 49–55, the disclosure of which is incorporated herein by reference.

A limitation of the guns as described above, is the gravity-field loading system. The present gravity-fed systems are limited to approximately 100–200 projectiles. However, the more projectiles contained in the magazine of the gravity-fed system the larger the magazine. The gravity magazine must be located above the gun for the gravity fed system to function. Hence, the user must carry a gun with a bulky gravity-fed magazine attached if he or she wants to have a large number of shots. In some applications such as when firing paint balls, users are most vulnerable to attack when they run out of ammunition, therefore the more shots the user has available the better.

As can be seen in FIG. 2 of U.S. Pat. No. 5,515,838, the gravity-field magazine is located on the top portion of the gun. The gravity-fed gun is sensitive to position to insure the projectiles will drop into position. Obviously, the gun cannot be held upside down or at certain angles or the projectiles will not drop. During simulated battles, utilizing the guns herein described, users may be running and moving quickly trying to hide and dodge attacks. While in the middle of such a heated exchange, a user's weapon may be held in a position that interferes with or prevents reloading using a gravity-fed magazine.

Furthermore, the projectiles can also exhibit a tendency to become "hung-up" in the magazine requiring the gun to be shaken by the user to get the projectiles to drop into position. This problem is analogous to pouring marbles through a funnel, sometimes they get hung-up.

There exists a need for a projectile gun loading apparatus that addresses each of the foregoing limitations.

SUMMARY OF THE INVENTION

The present invention is an automatic feeding device for use with a gun-like apparatus of the type described herein above and in Pat. No. 5,515,838. The gun-like apparatus typically use pressurized gas to fire projectiles. The projectiles may be small paint, gelatin, or tear gas filled balls that, when fired, rupture upon impact. The feeding device is portable, and capable of storing 500–1000 projectiles.

The present invention generally comprises a compressed gas cylinder connected in fluid communication via a solenoid valve to a hollow flexible tube or hose. The internal diameter of the flexible hose is selected to accept the size projectile to be utilized. The flexible hose contains a plurality of projectiles to be fired by the gun-like apparatus. The end of the flexible hose opposite the end connected to the compressed gas cylinder is connected to a projectile loading chamber of the gun-like apparatus.

The compressed gas cylinder and the length of flexible hose coiled up, can both be conveniently carried in a suitable manner such as in a pack carried on the back. The number of projectiles stored in the flexible hose is determined by the length of the hose. For example, approximately 28.5 feet of hose will contain 500 projectiles of approximately 0.68 inch diameter, and can be easily coiled and carried in a backpack along with the compressed gas cylinder. Longer coils of hose can be carried such that up to 1000 or more projectiles can be carried in one backpack.

The solenoid valve is electrically actuated by a battery power supply. A microswitch is mounted in the flexible hose and located near the end of the hose that is attached to the loading chamber of the gun-like apparatus. The microswitch is electrically connected to the solenoid valve and the battery power supply. The microswitch is sized and positioned such that it is depressed by each projectile as the projectile advances past the microswitch in the hose.

When the gun-like apparatus is fired and the projectiles advance in the hose, a projectile depresses the microswitch. The depressed microswitch activates the solenoid valve causing compressed gas to flow into the hose. The compressed gas flowing through the hose and into the reload chamber, or breach, of the gun-like apparatus positively forces a projectile into the breach of the gun-like apparatus.

The compressed gas cylinder can be equipped with a gage to determine internal gas pressure.

The compressed gas cylinder used for the auto feeder can be a separate cylinder from the compressed gas cylinder used to fire the gun-like apparatus. Alternately, one cylinder can be used with a manifold system to supply gas to both the present invention and to the gun-like apparatus for firing the projectiles.

The projectiles can be preloaded into the flexible hose by vacuum.

Positive loading of a projectile into the gun-like apparatus by compressed gas flow, as provided by the present invention, makes loading the gun-like apparatus independent of the gun's orientation. Unlike that in gravity-fed loading, loading using the present invention can take place when the gun is upside down or at any angle.

A user having 500–1000 projectiles as provided by the present invention will not likely run out of projectiles as can happen when limited to the small number of projectiles that can be stored in a conventional gravity-fed magazine.

Accordingly, it is an objective of the present invention to provide a portable pressurized gas projectile loading apparatus for use on a pressurized gas projectile firing gun-like apparatus.

It is a further objective of the present invention to provide a pressurized gas projectile loading apparatus that operates with a pressurized gas projectile firing gun-like apparatus when the gun-like apparatus is held in nearly any position.

It is another objective of the present invention to provide a portable and automatic pressurized gas projectile loading apparatus that holds more projectiles than a conventional gravity-field magazine holds.

In accordance with these and other objects which will become apparent hereinafter, the instant invention will now be described with particular reference to the accompanying drawings.

DESCRIPTION OF THE PREFERRED EMBODIMENTS

Figure 1:
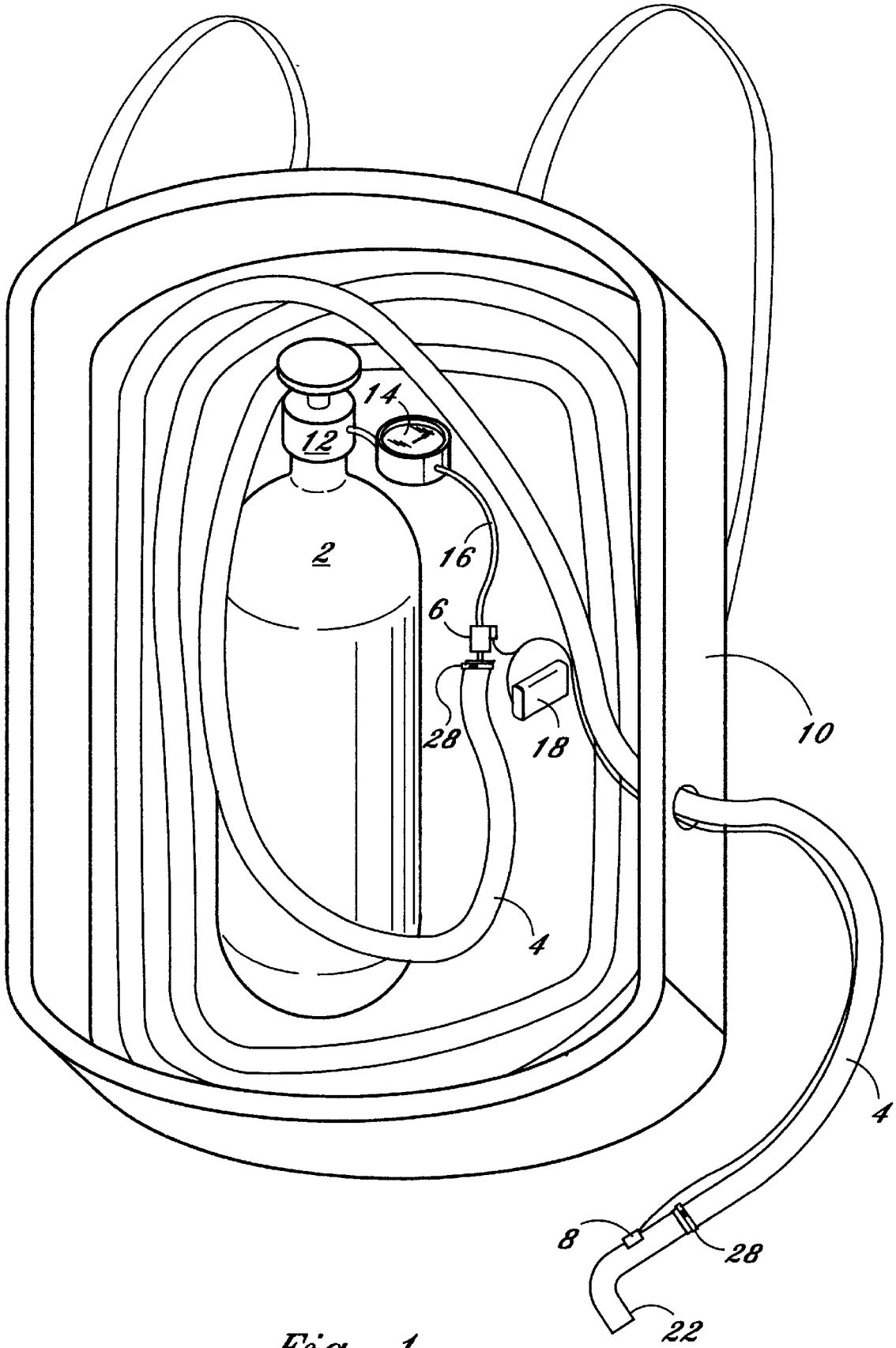
FIG. 1 is a perspective view of the present invention.
Figure 2:
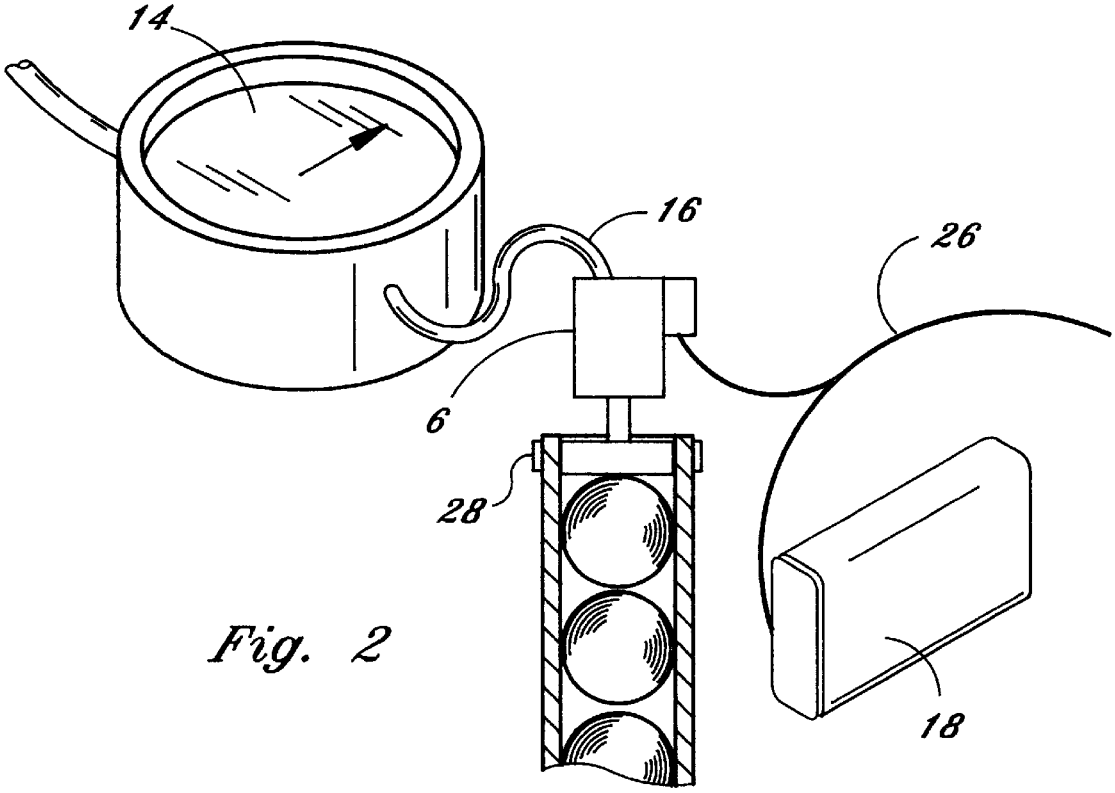
FIG. 2 is an enlarged perspective view in partial cut away of the entry end of the flexible hose of the present invention.

Referring now to FIGS. 1 and 2, the present invention generally comprises compressed gas cylinder 2, hollow flexible tube or hose 4, solenoid valve 6, microswitch 8, and backpack 10. Compressed gas cylinder 2 is connected from valve 12 to solenoid valve 6 through gage 14 by air hose 16. Solenoid valve 6 is electrically connected to power supply 18 and microswitch 8. Power supply 18 is preferably a battery power supply containing at least one battery to supply power to actuate solenoid valve 6. Solenoid valve 6 is connected to flexible hose 4 such that when solenoid valve 6 is actuated on, compressed gas flows from cylinder 2 through air hose 16 and into flexible hose 4.

Flexible hose 4 is made of a suitable material such as polyvinylchloride or equivalent, and sized such that the internal diameter is just slightly larger than the diameter of projectiles 20 such that projectiles 20 will freely move through the interior of hose 4. Projectiles 20 are selected to be utilized with the particular gun-like apparatus to be used with the present invention, such as that disclosed in U.S. Pat. No. 5,515,838. Projectiles 20 may be any suitably sized projectiles such as, but not limited to, paint, gelatin, or tear gas filled balls of essentially spherical shape. Hose 4 can be any suitable length, for example approximately 28.5 feet can be utilized to store approximately 500 projectiles 20, of 0.68 inch diameter.

Cylinder 2 and hose 4 in coiled position are contained in pack 10 preferably to be worn on the back of a user. Up to approximately 1000 projectiles can be stored in coiled hose 4 and conveniently carried in a backpack such as pack 10. A suitable length of hose 4, near feed end 22, will be left uncoiled for attachment to the gun-like apparatus and to allow unhindered movement of the gun by the user.

Figure 3:
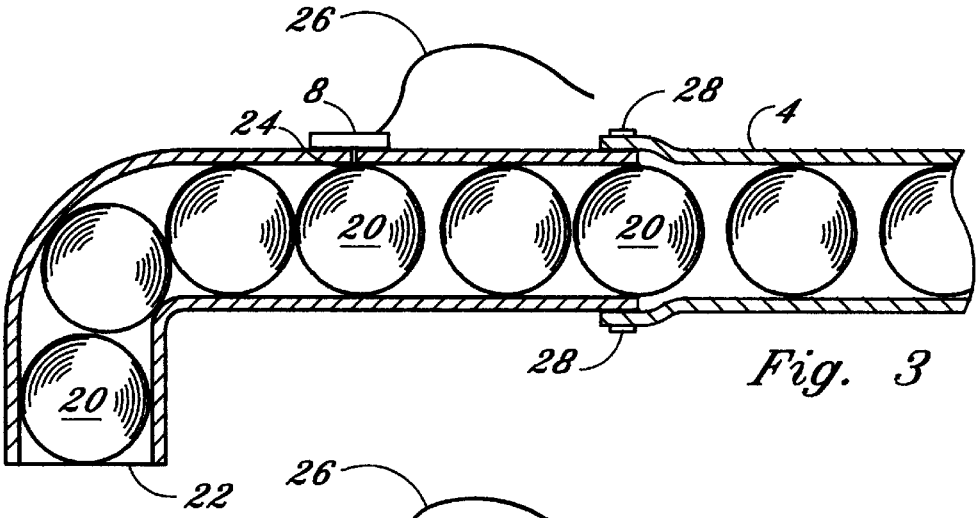
FIG. 3 and 4 are side elevational views in partial cut away of the exit end of the flexible hose of the present invention showing the microswitch in two different positions.
Figure 4:
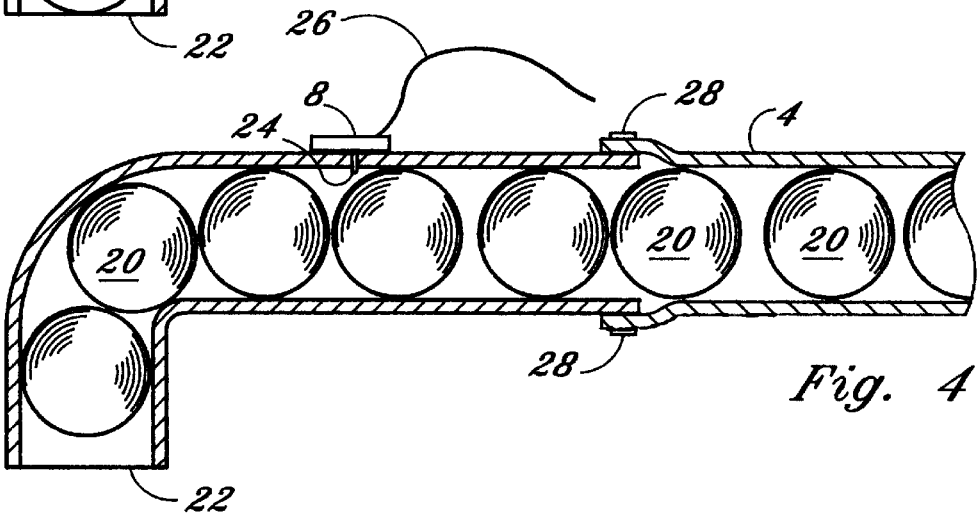

Referring now to FIGS. 3 and 4, microswitch 8 is mounted near the gun-like apparatus feed end 22 of hose 4 such that as projectiles 20 pass through hose 4 the plunger 24 of microswitch 8 is depressed by each projectile 20 that passes microswitch 8. Microswitch 8 is electrically connected to solenoid valve 6 and power supply 18 in a suitable manner such as wires 26. Power supply 18 is preferably a battery pack containing suitable battery power to actuate solenoid valve 6. For example, solenoid valve 6 may be selected to be powered by a 9 volt battery, AA batteries, or a combination of other suitable batteries as known in the art.

Solenoid valve 6 is actuated every time microswitch 8 is depressed by a projectile 20 passing over plunger 24. Microswitch 8 is an on/off type switch. Every time solenoid 6 is actuated by depressing plunger 24 on microswitch 8, compressed gas from cylinder 2 flows into flexible hose 4.

Figure 5:
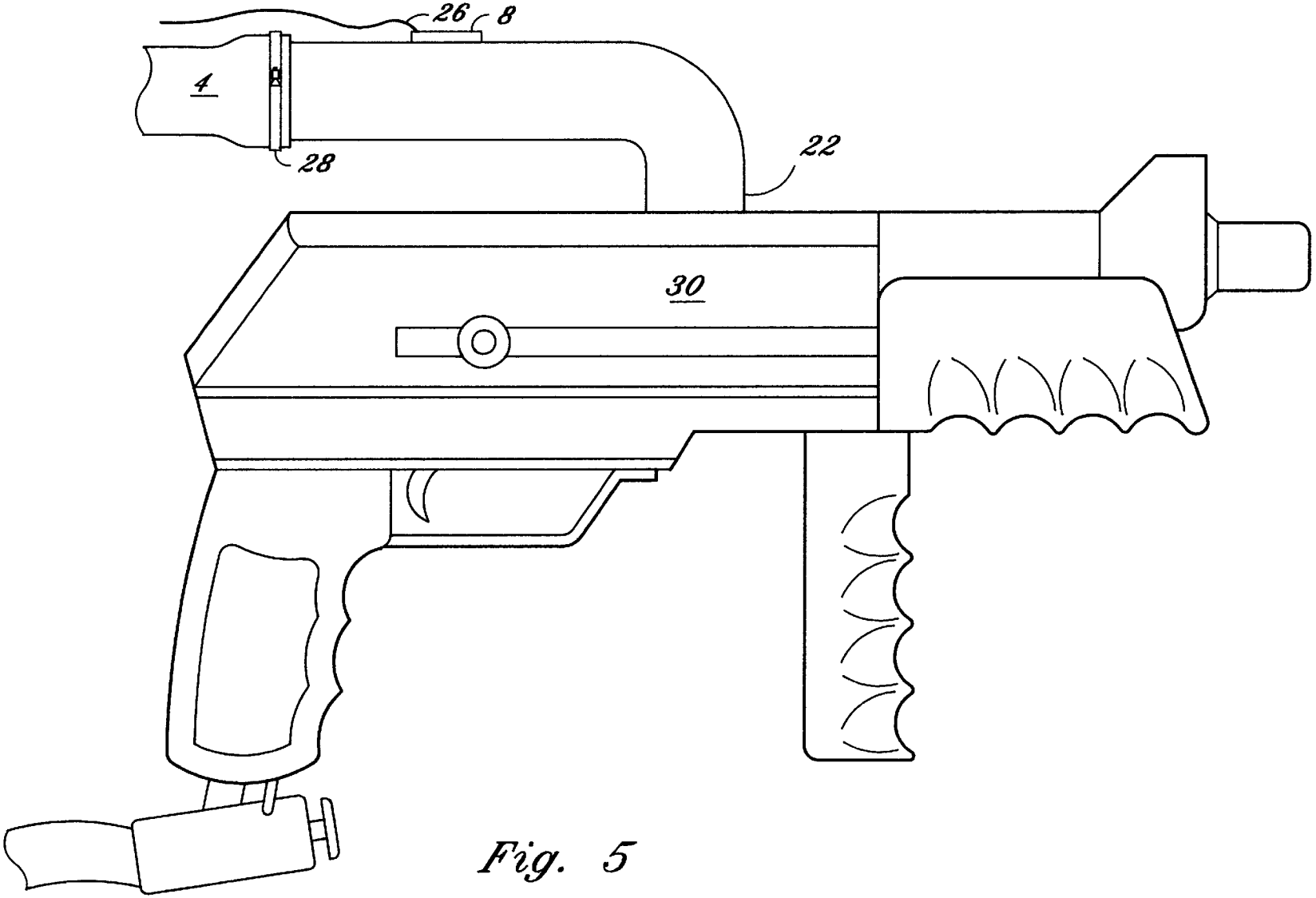
FIG. 5 is a side elevational view of the exit end of the present invention connected to an example of a gun-like apparatus that can be utilized with the present invention.

Referring now to FIG. 5, feed end 22 of hose 4 is attached to the loading magazine port of a suitable gun-like apparatus 30, such as that disclosed in Pat. No. 5,515,838. Feed end 22 is made of any suitable material such as polyvinylchloride or equivalent material as known in the art, and configured to attach to the particular gun-like apparatus to which it will be connected. The gravity-fed magazine from the gun-like apparatus can be used as a guide for this purpose (not shown).

The attachment of hose 4 to solenoid valve 6 and to feed end 22 is accomplished by any suitable fastener such as glue, cable ties, hose clamps 28, or equivalents thereof as known in the art.

Operation of the present invention will be better understood by referring to FIGS. 5 and 11 of U.S. Pat. No. 5,515,838 ('838), as an example of one gun-like apparatus that may be utilized with the present invention. Referring now to FIG. 5 of '838, in operation, when the gun-like apparatus is cocked, a projectile 20 (numbered 23 in '838) drops through the breach opening 67 and into the loading chamber, or breach 69, of the gun-like apparatus. When the trigger is depressed in the gun-like apparatus, the bolt 53 moves forward closing the breach opening 67 and pushing the projectile 20 (23 in '838) into the barrel 27 for firing using compressed gas, as shown in FIG. 11 of '838. The bolt then moves back into the recocked position, as shown in FIG. 5 of '838, and the next projectile 20 (23 in '838) can drop into position into the breach 69.

During the operation of the gun-like apparatus using the present invention, when the gun is fired and a projectile 20 moves past microswitch 8, solenoid valve 6 is actuated allowing compressed gas to flow into flexible hose 4. Compressed gas flowing into hose 4 will be expelled through the feed end 22 of hose 4 and into the breach of the gun-like apparatus when the breach is opened after firing and upon recocking. The compressed gas flowing from cylinder 2, through hose 4, through feed end 22, and out into the breach of the gun-like apparatus forces or propels a projectile 20 into the breach of the gun. In this manner, each projectile is fed into the breach one at a time and independent of gun orientation.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An automatic projectile feeding device for a gun-like apparatus comprising:

means for supplying compressed gas;

means for movably storing a plurality of projectiles;

means for removably attaching said means for movably storing to the gun-like apparatus, said means for removably attaching connected to said means for movably storing, said means for removably attaching in fluid communication with said means for movably storing and in fluid communication with said gun-like apparatus;

means for activating said means for supplying compressed gas, said means for activating connected to said means for movably storing, said means for supplying compressed gas in fluid communication with said means for movably storing when activated by said means for activating; and, means for portably housing said means for supplying compressed gas, said means for movably storing, and said means for activating, said means for portably housing being attachable to the body of a user.

2. The device as claimed in claim 1 wherein said means for activating is an open and close valve connected to said means for movably storing;

a switch electrically connected to said valve and to a power supply, to open and close said valve, said switch mounted to said means for movably storing, said switch having an actuating plunger penetrating said means for movably storing, said plunger being depressed by at least a portion of one each of said plurality of projectiles in said means for movably storing, said means for supplying compressed gas in fluid communication with said means for movably storing when said switch opens said valve by actuating said plunger by one of said plurality of projectiles;

said means for portably housing further including said open and close valve and said power supply.

3. An automatic projectile feeding device for a gun-like apparatus comprising:

means for supplying compressed gas;

a flexible hose having an entry end and an exit end, said hose sized internally to closely receive and pass a projectile therethrough, said flexible hose sized in length to house a plurality of projectiles;

a valve connected to said entry end of said flexible hose, said valve movable between an open position and a closed position, said valve in fluid communication with said means for supplying compressed gas;

means for supplying power;

a switch, said switch electrically connected to said means for supplying power and to said valve, said switch mounted to said flexible hose, said switch having an actuating plunger, said plunger internally penetrating said flexible hose, said plunger being depressed by each of said plurality of projectiles passing therethrough said flexible hose;

said flexible hose removably connected to a gun-like apparatus at said exit end, said flexible hose in fluid communication with said gun-like apparatus;

said flexible hose in fluid communication with said means for supplying compressed gas when said valve is in said open position by actuation of said plunger by passing of each of said plurality of projectiles through said flexible hose.

4. The device as claimed in claim 3 wherein said means for supplying power is at least one battery.

5. The device as claimed in claim 3 further including a portable housing sized to receive said flexible hose, said means for supplying compressed gas, said valve, and said means for supplying power.

6. An automatic projectile feeding device for a gun-like apparatus comprising:

a compressed gas cylinder removably mounted in a portable housing;

a flexible hose having an entry end and an exit end, said hose sized internally to closely receive and pass a projectile therethrough, said flexible hose sized in length to house a plurality of projectiles, said flexible hose removably stored in said portable housing;

a valve connected to said entry end of said flexible hose, said valve movable between an open position and a closed position, said valve in fluid communication with said compressed gas cylinder;

at least one battery;

a switch, said switch electrically connected to said at least one battery and to said valve, said switch mounted to said flexible hose, said switch having an actuating plunger, said plunger internally penetrating said flexible hose, said plunger being depressible by each of said plurality of projectiles passing therethrough said flexible hose;

said flexible hose removably connected to a gun-like apparatus at said exit end, said flexible hose in fluid communication with said gun-like apparatus;

said flexible hose in fluid communication with said compressed gas cylinder when said valve is in said open position by actuation of said plunger by passing of each of said plurality of projectiles through said flexible hose.

* * * * *